US010779665B2

(12) United States Patent
Durfee

(10) Patent No.: US 10,779,665 B2
(45) Date of Patent: Sep. 22, 2020

(54) WEIGHTED TARGET APPLICATOR

(71) Applicant: Creatrix Solutions LLC, Kennewick, WA (US)

(72) Inventor: Eileen Durfee, Kennewick, WA (US)

(73) Assignee: Creatrix Solutions LLC, Kennewick, WA (US)

( * ) Notice: Subject to any disclaimer, the term of this patent is extended or adjusted under 35 U.S.C. 154(b) by 28 days.

(21) Appl. No.: 16/337,274

(22) PCT Filed: Sep. 28, 2017

(86) PCT No.: PCT/IB2017/055987
§ 371 (c)(1),
(2) Date: Mar. 27, 2019

(87) PCT Pub. No.: WO2018/060936
PCT Pub. Date: Apr. 5, 2018

(65) Prior Publication Data

US 2020/0030658 A1 Jan. 30, 2020

Related U.S. Application Data

(60) Provisional application No. 62/400,964, filed on Sep. 28, 2016.

(51) Int. Cl.
*A47G 9/10* (2006.01)
*A63B 21/078* (2006.01)
(Continued)

(52) U.S. Cl.
CPC ..... *A47G 9/1045* (2013.01); *A47C 7/383* (2013.01); *A47C 7/425* (2013.01); *A47C 20/027* (2013.01);
(Continued)

(58) Field of Classification Search
CPC ..... A47G 9/1045; A47G 9/1081; A63B 21/4027; A63B 21/078; A63B 23/00;
(Continued)

(56) References Cited

U.S. PATENT DOCUMENTS 1,291,465 A * 1/1919 Foreman ..... A63B 21/065 482/105
2,506,685 A * 5/1950 Checkowitz ..... A45F 5/00 362/108

(Continued)

*Primary Examiner* — Garrett K Atkinson

(57) ABSTRACT

A weighted target applicator is an apparatus that applies weight directly to specific parts of the body of a user. The apparatus includes at least one pad, a setting, a structural base, and a barbell mount. The pad is detachably attached onto the setting, the structural base is mounted onto the setting, opposite to the pad. The barbell mount is mounted onto the structural base, opposite the setting. In a first embodiment and a second embodiment, the structural base is rotatably connected to the setting. The at least one pad of the first embodiment conforms to the chest. The at least one pad of the second embodiment conforms to the hip. In a third embodiment, the structural base is fixed to the setting. The at least one pad of the third embodiment includes a first pad and a second pad that are shaped to receive the face of the user.

8 Claims, 6 Drawing Sheets

(51) Int. Cl.

| | |
|---|---|
| ***A63B 23/00*** | (2006.01) |
| ***A63B 21/072*** | (2006.01) |
| ***A63B 21/00*** | (2006.01) |
| ***A47C 7/38*** | (2006.01) |
| ***A47C 7/42*** | (2006.01) |
| ***A47C 20/02*** | (2006.01) |

(52) U.S. Cl.
CPC ..... *A47G 9/1081* (2013.01); *A63B 21/072* (2013.01); *A63B 21/078* (2013.01); *A63B 21/4027* (2015.10); *A63B 23/00* (2013.01)

(58) Field of Classification Search
CPC ..... A63B 21/072; A47C 7/383; A47C 7/425; A47C 20/027
See application file for complete search history.

(56) References Cited

U.S. PATENT DOCUMENTS 3,256,015 A * 6/1966 Perrin ..... A63B 21/04 482/129
3,322,425 A * 5/1967 Moore ..... A63B 21/4001 482/105
3,370,850 A * 2/1968 Moore ..... A63B 21/4001 482/105
3,384,370 A * 5/1968 Bailey ..... A63B 21/0724 482/106
3,500,472 A * 3/1970 Castellani ..... A42B 3/12 2/462
3,679,107 A * 7/1972 Perrine ..... A45F 3/14 224/201
3,751,031 A * 8/1973 Yamauchi ..... A63B 21/065 482/105
3,953,024 A * 4/1976 Brubacher ..... B63H 1/38 472/127
3,972,238 A * 8/1976 Thatcher ..... A61B 5/224 482/128
4,018,442 A * 4/1977 Galler ..... A63B 21/0724 482/106
4,213,605 A * 7/1980 McPeak ..... A63B 21/072 224/201
D272,375 S * 1/1984 Fuller, Sr. ..... D21/694
4,461,473 A * 7/1984 Cole ..... A63B 21/0004 482/106
4,618,142 A * 10/1986 Joseph, Jr. ..... A63B 5/20 482/106
4,618,143 A * 10/1986 Twardosz ..... A63B 21/0724 482/106
4,629,184 A * 12/1986 Selkee ..... A63B 21/0724 482/106
4,722,524 A * 2/1988 Waszkelewicz ... A63B 21/4005 224/265
D303,697 S * 9/1989 Pearson ..... D21/682
4,865,314 A * 9/1989 Carter, Jr. ..... A63B 21/0724 482/106
D305,256 S * 12/1989 Pearson ..... D21/682
RE33,218 E * 5/1990 Twardosz ..... A63B 21/0724 482/106
4,944,509 A * 7/1990 Snider ..... A63B 21/065 482/105
4,986,536 A * 1/1991 Zane ..... A63B 21/4005 224/266
5,024,434 A * 6/1991 Smith ..... A63B 21/0724 482/106
5,080,349 A * 1/1992 Vittone ..... A63B 23/14 482/106
5,118,100 A * 6/1992 Sungaila ..... A63B 21/0724 482/105
5,167,600 A * 12/1992 Baird ..... A63B 21/065 482/100
5,169,364 A * 12/1992 Donaldson ..... A63B 21/065 482/105
5,211,615 A * 5/1993 Sides ..... A63B 21/065 482/105
5,211,616 A * 5/1993 Riley, Jr. ..... A63B 21/072 482/106
5,254,063 A * 10/1993 House, Jr. ..... A63B 21/0728 403/104
5,334,113 A * 8/1994 Roepke ..... A63B 21/0724 482/106
5,342,272 A * 8/1994 Pittroff ..... A63B 21/072 224/265
5,417,635 A * 5/1995 Sell ..... A63B 21/0605 482/105
5,433,686 A * 7/1995 Marsh ..... A63B 21/078 482/104
5,472,398 A * 12/1995 Silverman ..... A63B 21/4005 482/105
5,531,657 A * 7/1996 Macedo ..... A63B 21/0084 482/106
D381,516 S * 7/1997 Andryzeck ..... D3/327
5,653,665 A * 8/1997 Neeley ..... A63B 21/0552 482/106
5,718,654 A * 2/1998 Kennedy ..... A63B 21/154 482/102
5,725,461 A * 3/1998 Bogard, II ..... A63B 21/072 482/106
5,846,169 A * 12/1998 Tscheschlog ..... A63B 21/4005 482/105
5,897,468 A * 4/1999 Lumpkin ..... A63B 69/00 2/463
5,957,818 A * 9/1999 Betournay ..... A63B 21/065 482/105
6,224,518 B1 * 5/2001 Weiss ..... A63B 21/078 482/104
6,371,893 B1 * 4/2002 Redden ..... A63B 21/065 482/104
6,612,971 B1 * 9/2003 Morris ..... A63B 23/047 473/441
6,652,420 B2 * 11/2003 Chen ..... A63B 23/12 482/139
D505,459 S * 5/2005 Lagattuta ..... D21/680
6,942,585 B1 * 9/2005 Krause ..... A63B 69/002 473/445
7,112,164 B1 * 9/2006 Hoagland ..... A63B 21/0724 482/106
D535,336 S * 1/2007 Diakonov ..... D21/679
7,322,905 B2 * 1/2008 Morris ..... A63B 23/047 482/118
D579,990 S * 11/2008 Dalcourt ..... D21/662
7,549,951 B2 * 6/2009 Scrivens ..... A63B 21/072 482/108
7,862,486 B1 * 1/2011 Watson ..... A63B 21/0724 482/106
8,047,973 B2 * 11/2011 Berenshteyn ..... A63B 21/0724 482/100
8,109,863 B2 * 2/2012 Gilberti ..... A63B 21/0603 473/438
8,157,713 B1 * 4/2012 Siskowic ..... A63B 21/0004 482/141
8,231,511 B2 * 7/2012 Dalcourt ..... A63B 21/0607 482/106
D671,996 S * 12/2012 Wierszewski ..... D21/680
8,360,938 B2 * 1/2013 Gilman ..... A63B 21/0615 482/51
8,651,972 B2 * 2/2014 Hoeschler ..... A63B 22/16 446/153
8,672,815 B1 * 3/2014 Springer ..... A63B 21/0724 482/106
9,358,419 B1 * 6/2016 Smith ..... A63B 21/06
D797,217 S * 9/2017 Gilbert ..... D21/681
10,589,143 B1 * 3/2020 Smythe ..... A63B 21/4005
2003/0224914 A1 * 12/2003 De Montesquieux ..... A63B 41/00 482/148
2004/0002408 A1 * 1/2004 Rigas ..... A63B 21/4035 482/82

(56) References Cited

U.S. PATENT DOCUMENTS

| | | | | |
|---|---|---|---|---|
| 2006/0116256 | A1* | 6/2006 | Carney | A63B 21/072 482/106 |
| 2006/0264300 | A1* | 11/2006 | Chen | A63B 69/0079 482/14 |
| 2007/0287609 | A1* | 12/2007 | McBride | A63B 21/065 482/105 |
| 2013/0095984 | A1* | 4/2013 | Agate | A63B 23/047 482/106 |
| 2013/0130814 | A1* | 5/2013 | Hoeschler | A63B 26/003 472/127 |
| 2014/0145407 | A1* | 5/2014 | Chen | B62B 1/264 280/47.12 |
| 2015/0065315 | A1* | 3/2015 | Ferrell | A63B 21/0783 482/104 |
| 2015/0072839 | A1* | 3/2015 | Dalessio | A63B 21/078 482/104 |
| 2015/0126344 | A1* | 5/2015 | Wehrell | A63B 24/0087 482/128 |

* cited by examiner

WEIGHTED TARGET APPLICATOR

The current application is a 371 of international Patent Cooperation Treaty (PCT) application PCT/IB2017/055987 filed on Sep. 28, 2017.

The PCT application PCT/IB2017/055987 claims a priority to the U.S. Provisional Patent application Ser. No. 62/400,964 filed on Sep. 28, 2016.

FIELD OF THE INVENTION

The present invention relates generally to a weighted target applicator. More specifically, the present invention is weighted target applicator that strengthens specific muscles groups of the body of a user by both comfortably and directly applying weight to strategic anterior positions along the body as the user is performing a variety of exercises. A variety of dumbbells, barbells, and other weighted accessories is attachable to the present invention in order to accommodate the strength of a variety of users and the increasing strength of an individual user.

BACKGROUND OF THE INVENTION

Humans are unique in many aspects when compared to any other species. One of the defining traits of the humans is an exclusive S-shaped posture. The vertebral column is one of the most important parts of our musculoskeletal system. Effective mobility is defined with the ability to sit upright and move on two legs, with respect to the effect of gravity. The human backbone houses the spinal cord, which serves as the main pathway connecting the brain to the nervous system. Due to the overall complexity of the spine, even light damage can cause serious medical issues, that can lead to constant pain, and in more severe cases even paralysis. Generally, serious injuries occur due to physical trauma to the backbone area. However other factors, such as prolonged improper posture, can have a major impact as well. A plurality of issues can be caused by an improper posture, leading to constant pain and discomfort as a result of weakening muscles in the musculoskeletal structure. Poor posture differs from person to person. Individuals may be more susceptible to poor posture depending on body type and genetics.

The best way to ensure comfortable long-term living is to maintain a correct posture. Back pain can be self-inflicted due to a lifetime of bad habits, that is why understanding and maintaining an accurate posture that maintains the natural shape of the vertebral column is very important. The spine is not only responsible for support and movement, but it is one of the key factors that ensures proper function of the nervous system. Humans are born with what is known as a C-shaped curve. Development, during infancy leads to the lifting of the head and the curve in the neck starts to form forward thus creating the defining unique shape of the backbone. Some of the more important roles of the vertebral column are protection, support, and movement. The vertebrae which make up the vertebral structure of the spinal cord, allow it to conduct these functions.

The present invention aims to create an improved way of reshaping the vertebral column, by applying opposing forces anteriorly and posteriorly to the spine without the need for complex equipment that can only be found at a specialized facility. The present invention is positioned onto any flat supporting surface for use with the body in the supine position. A plurality of factors is the cause for the deformation of the vertebral column. Some of the more common ones occur through aging, repetitive motion injuries, physical trauma or as mentioned above continuous incorrect posture. Incorrect posture not only affects the shape of the backbone but it can also weaken and/or strengthen certain muscles. Weakened muscles leading to the loss of the spinal curvature, can disable the human body, especially the back. Restoring the S-shaped curvature in the human spine, can act as an effective permanent pain relief method for a plurality of medical conditions, therefore directly improving the quality of life.

DETAILED DESCRIPTION OF THE INVENTION

All illustrations of the drawings are for the purpose of describing selected versions of the present invention and are not intended to limit the scope of the present invention.

The present invention is a weighted target applicator that strengthens specific muscle groups of the body of a user. The present invention encourages proper form while performing a variety of exercises over posterior supports and serves as a universal attachment for varying weighted dumbbells, barbells, and other similar weighted accessories. In order to comfortably and directly apply weight to the body, thereby forcing certain muscle groups to engage while performing an exercise. The present invention comprises at least one pad 1, a setting 6, a structural base 11, and a barbell mount 17, seen in each embodiment of FIG. 1, FIG. 4, FIG. 5, and FIG. 6. The at least one pad 1 conforms to the specific area of the body of the user. The at least one pad 1 cushions the user from the sharp and hard edges of the setting 6. The setting 6 and the structural base 11 effectively supports the weight of the barbell mount 17 and a weight attached to the barbell mount 17. More specifically, the setting 6 connects the at least one pad 1 to the structural base 11 and the barbell mount 17, and the structural base 11 serves as a mount for the barbell mount 17. The barbell mount 17 serves as a universal adapter for a variety of weighted items such as dumbbell and barbells.

The overall configuration of the aforementioned components defines an individual weighted target adapter that applies weight to specific areas of the body of the user while correctly centering the weighted items on the user. In each embodiment seen in FIG. 1, FIG. 4, FIG. 5, and FIG. 6, The at least one pad 1 is detachably attached onto the setting 6. In the preferred embodiment of the present invention, the at least one pad 1 is detachably attached via a plurality of tee bolts and nuts mounted in a wooden mounting plate. The wooden mounting plate is integrated into the at least one pad 1 and positioned between the at least one pad 1 and the setting 6. however, it is understood that a variety of fasteners may attach the at least one pad 1 to the setting 6. The variety of fasteners preferably does not damage the integrity of the at least one pad 1, as the tee nuts are embedded into the underside of the wood mounting plane. The structural base 11 is mounted onto the setting 6, opposite the at least one pad 1, and the barbell mount 17 is mounted onto the structural base 11, opposite the setting 6. This arrangement effectively aligns the weight item about the at least one pad 1 and prevents the weighted item from coming into direct contact with the body of the user.

Figure 1:
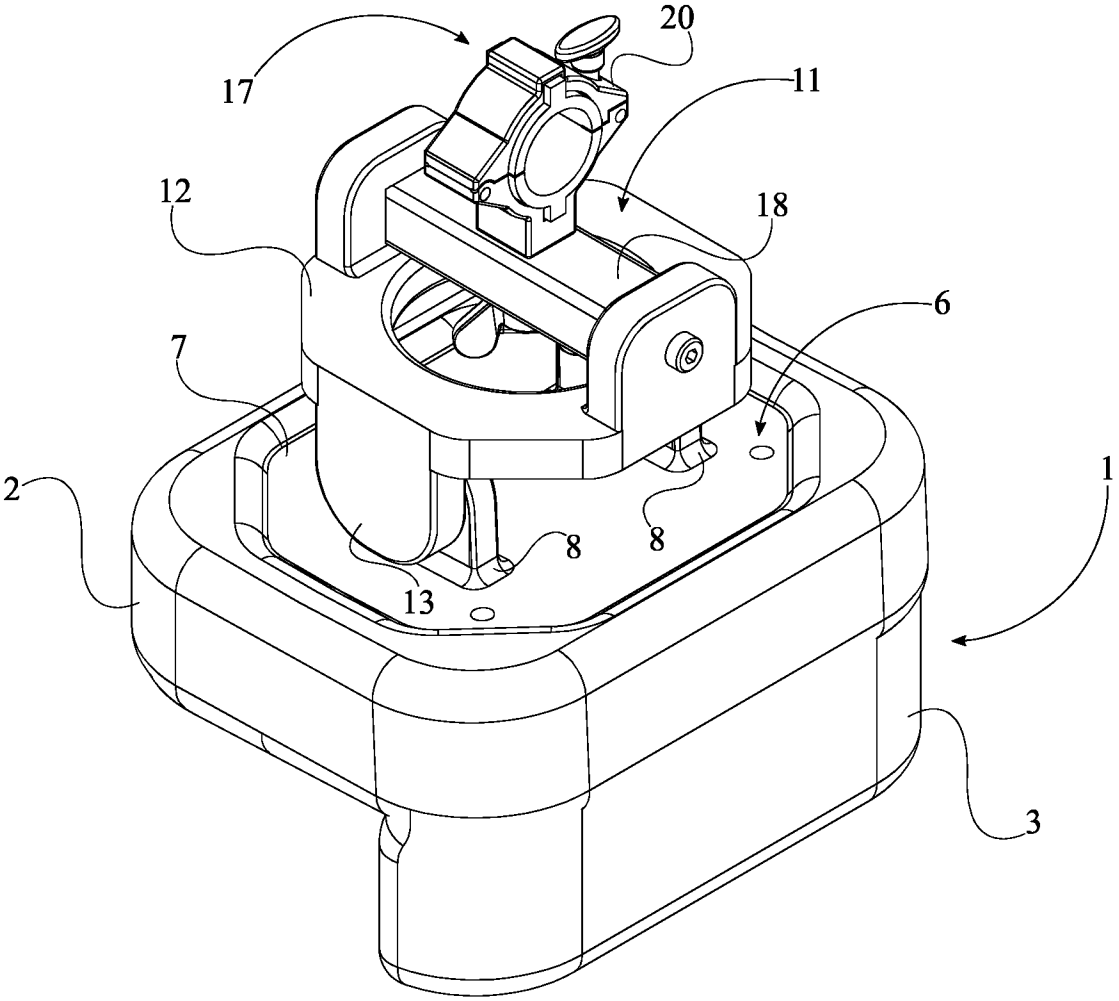
FIG. 1 is a perspective view of the second embodiment of the present invention.
Figure 2:
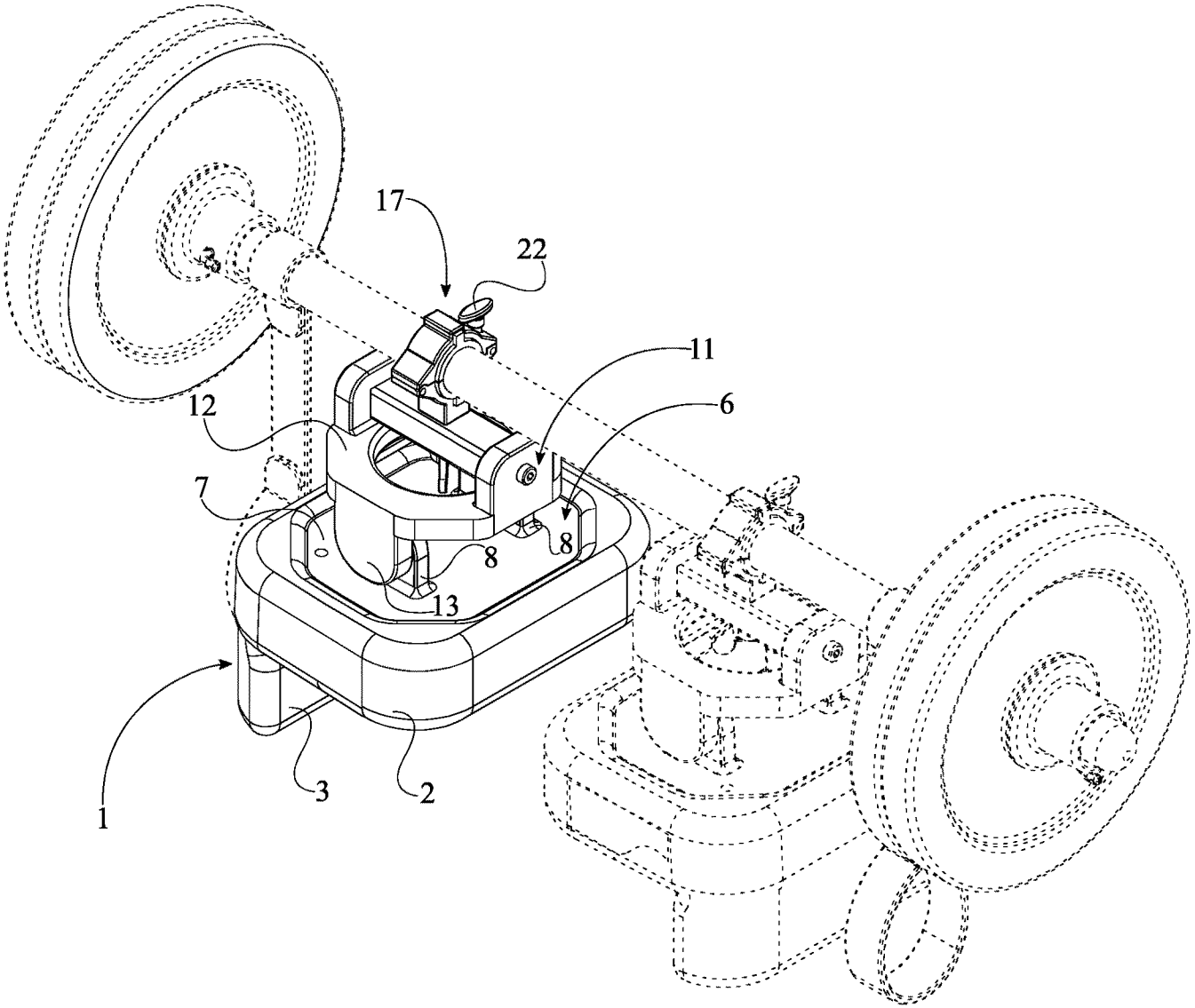
FIG. 2 is a perspective view of the second embodiment of the present invention engaged with a weighted item.
Figure 3:
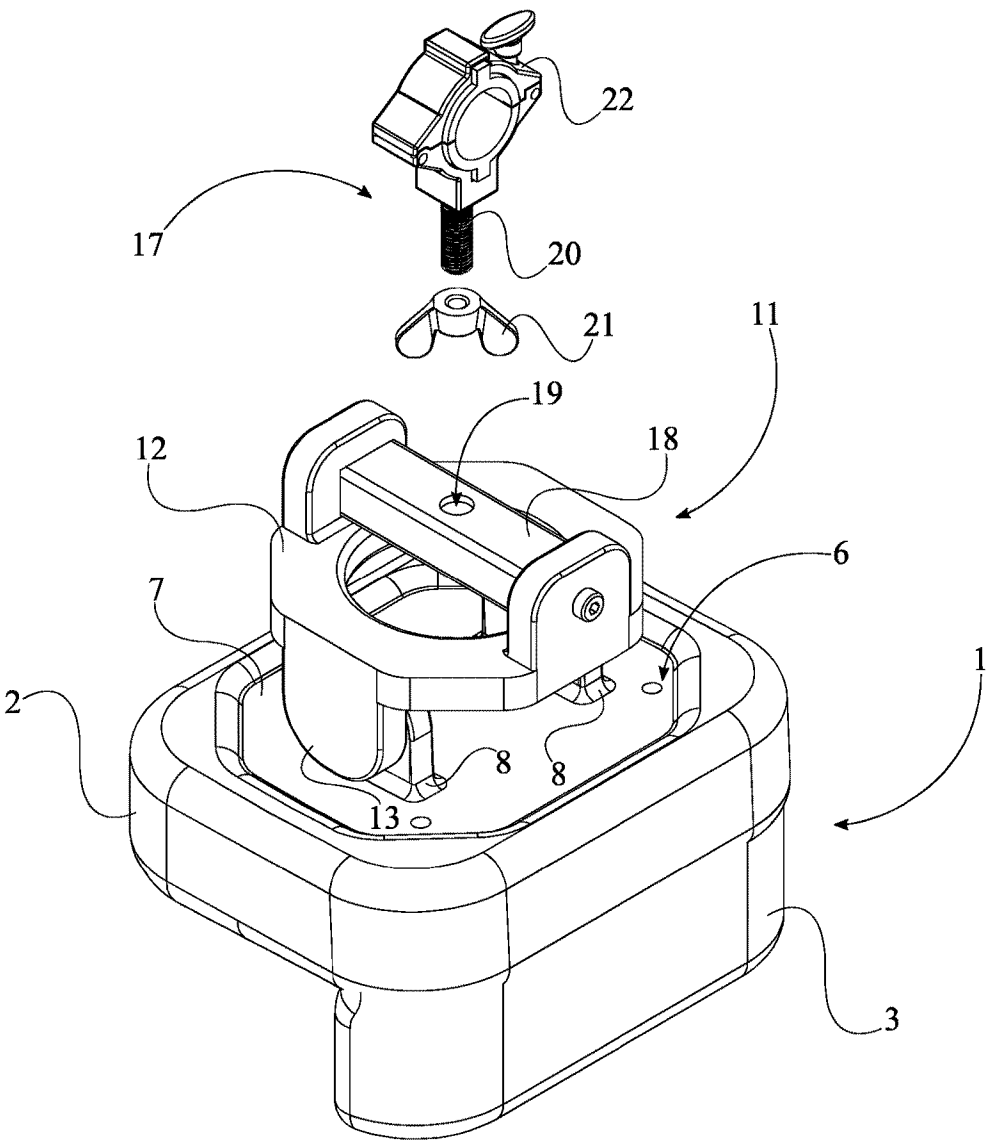
FIG. 3 is an exploded view of the second embodiment of the present invention.
Figure 4:
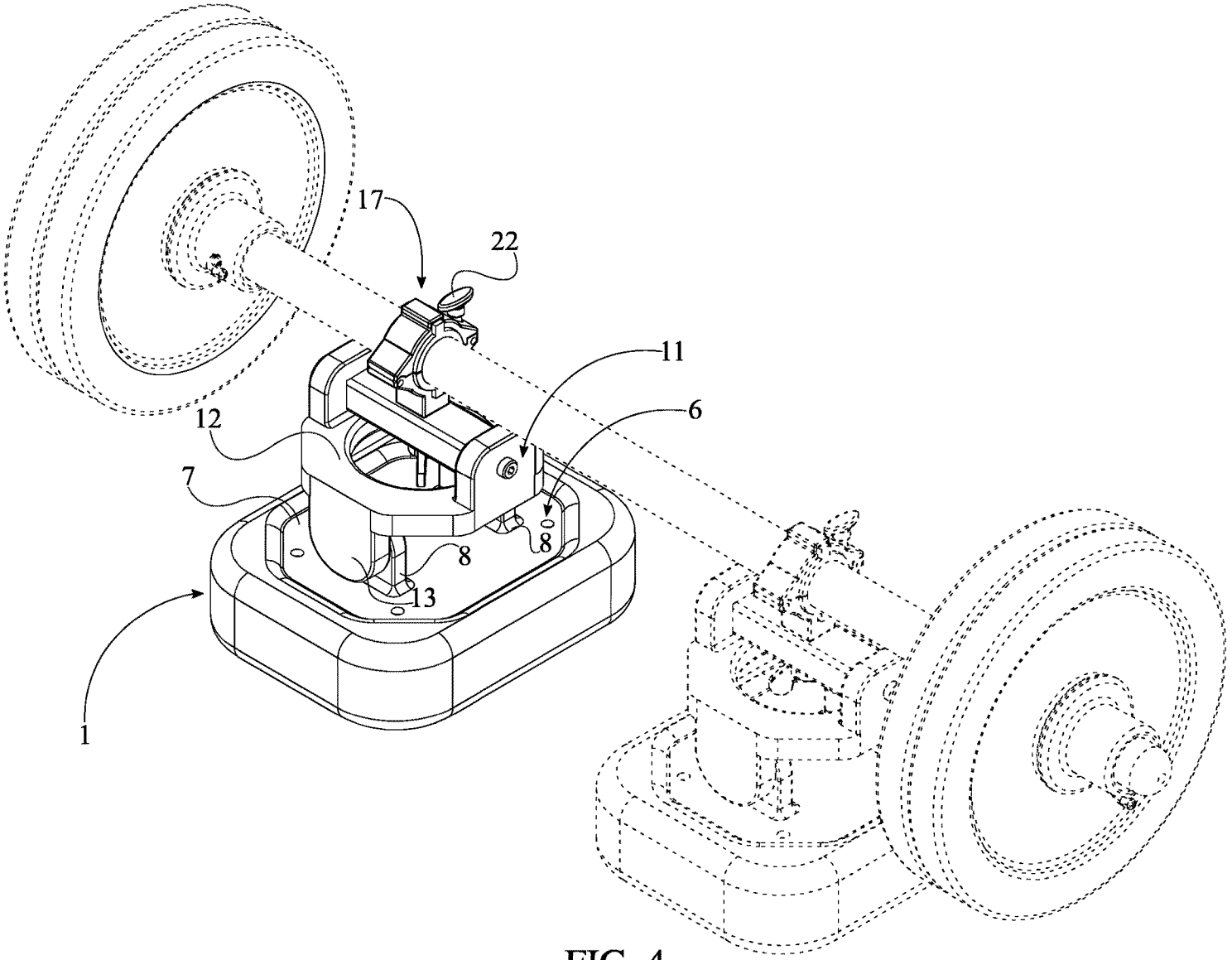
FIG. 4 is a perspective view of the first embodiment of the present invention engaged with a weighted item.

In a first and a second embodiment of the present invention, the weighted target adapter is used with another weighted target adapter as to stabilize the attached weighted item about the user, as shown in FIG. 2 and FIG. 4. More specifically, the attached weighted item is balanced on the user with at least two weighted target adapters in order to balance the weighted item on the user and force the user to focus and engage desired muscle groups. In the first embodiment and the second embodiment of the present invention, the weighted target adapter accommodates the fluid movement of the user allowing the center of gravity of the attached weighted item to shift and maximize effectiveness of the workout.

In order to accommodate the fluid movement of the user, the setting 6 comprises a first platform 7 and a first pair of clevis tabs 8, shown in FIG. 1, FIG. 2, FIG. 3, and FIG. 4. The first platform 7 stabilizes and centers the at least one pad 1 onto the setting 6. The first pair of clevis tabs 8 connects the first platform 7 to the structural base 11. The pad is mounted across the first platform 7, and the first pair of clevis tabs 8 is mounted onto the first platform 7, opposite the at least one pad 1. This arrangement prevents the structural base 11 and barbell mount 17 from coming into direct contact with the body of the user and possibly injuring the user. Furthermore, this arrangement allows for the rotation of the at least one pad 1 about an axis of rotation parallel to the body, thereby accommodating the contours of the body. The axis of rotation laterally traverses the body of the user. More specifically, the first pair of clevis tabs 8 is positioned parallel and offset from each other across the platform. The structural base 11 is rotatably connected to the first pair of clevis tabs 8, forcing the user to engage the proper muscle groups throughout an exercise as the weight item is properly centered about the user.

Furthermore, the structural base 11 of the first embodiment and the second embodiment of the present invention comprises a second platform 12 and a second pair of clevis tabs 13, also seen in FIG. 1, FIG. 2, FIG. 3, and FIG. 4. The second platform 12 positions the second pair of clevis tabs 13 and connects the setting 6 to the barbell mount 17. The second pair of clevis tabs 13 connects the second platform 12 to the setting 6. The barbell mount 17 is mounted onto the second platform 12, and the second pair of clevis tabs 13 is mounted onto the second platform 12, opposite the barbell mount 17. Similarly, this arrangement allows the barbell mount 17 to be connected to the at least one pad 1 without coming contact with the user. Similarly, this arrangement allows for the rotation of the at least one pad 1 about an axis of rotation parallel to the body, thereby accommodating the contours of the body. The axis of rotation laterally traverses the body of the user. More specifically, the second pair of clevis tabs 13 is positioned parallel and offset from each other across the second platform 12. The setting 6 is rotatably connected to the second pair of clevis tabs 13, forcing the user to engage the proper muscle groups throughout an exercise as the weighted item is properly centered about the user.

As illustrated in FIG. 4, the first embodiment of the present invention applies direct force to the chest of the user. In order for the first embodiment of the present invention to comfortably rest on the chest of the user, the at least one pad 1 is preferably planar. It is understood that the at least one pad 1 may comprise a structure that conforms to the chest of a specific user. The second embodiment of the present invention applies direct force to the hip of the user. In order for the second embodiment of the present invention to comfortably rest on the hip of the user, the at least one pad 1 comprises a first planar portion 2 and a second planar portion 3. Similar to the first embodiment of the present invention, the first planar portion 2 applies direct force onto the hip of the user. The second planar portion 3, however, hugs the hip as to better stabilize the attached weight onto the user forcing the user to engage specific muscle groups. The first planar portion 2 is mounted across the setting 6, and the second planar portion 3 is peripherally and perpendicularly connected to the first planar portion 2. This arrangement encourages the proper form of the user while using two targeted weight adapters along his or her hips. In order for the user to better control the attached weighted item, the user may attach a couple of straps to either side of the weighted item. Such straps are seen in FIG. 2.

Figure 5:
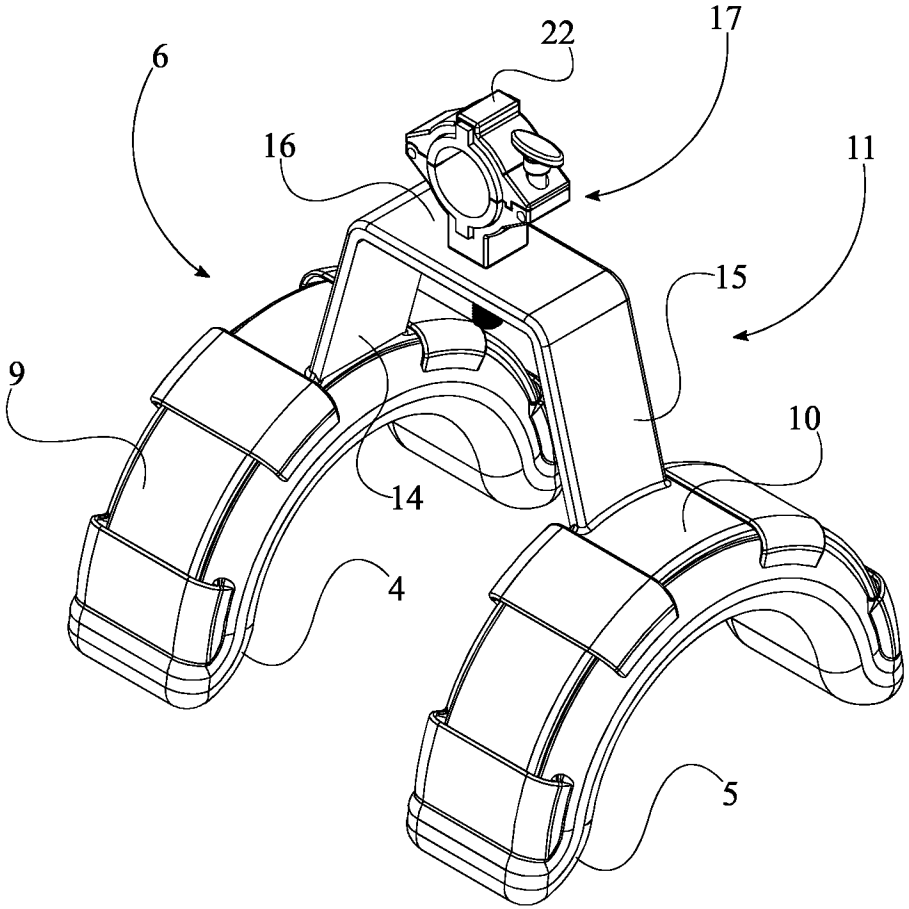
FIG. 5 is a perspective view of the third embodiment of the present invention.

In the third embodiment of the present invention, shown in FIG. 5, an individual target weighted adapter stabilizes the attached weighted item onto the face of the user. The center of gravity of the individual weighted target adapter with the attached weighted item is fixed in order to prevent injury to the neck of the user while maximizing effectiveness the workout.

In order to fix the center of gravity of the attached weighted item about the user, the structural base 11 comprises a first offset leg 14, a second offset leg 15, and a bridge 16, seen in FIG. 5. The first offset leg 14 and second offset leg 15 equally distributes the force of the attached weighted item on a given body part or area of the body of the user. The bridge 16 connects the first offset leg 14 and the second offset leg 15 to one another. The bridge 16 also connects both the first offset leg 14 and the second offset leg 15 to the barbell clamp 22. The center of gravity of the attached weighted item is fixed about the user as the first offset leg 14 is terminally mounted to the bridge 16, and the second offset leg 15 is terminally mounted to the bridge 16, opposite the first offset leg 14. The setting 6 is mounted onto the first offset leg 14 and the second offset leg 15, and the barbell clamp 22 is mounted onto the bridge 16 between the first offset leg 14 and the second offset leg 15. The arrangement allows a user to comfortably use the third embodiment of the present invention while structurally upholding the attached weighted item via the barbell clamp 22.

Figure 6:
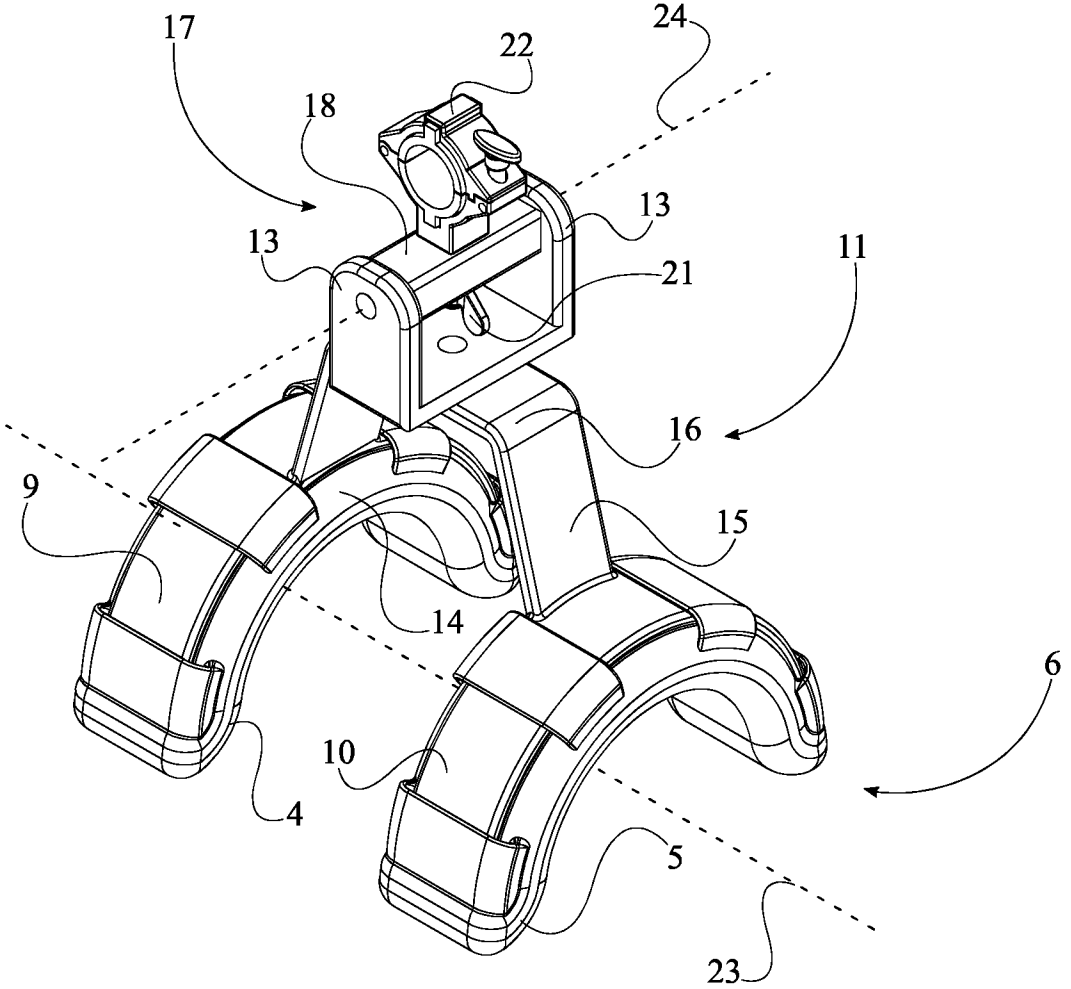
FIG. 6 is a perspective view of the fourth embodiment of the present invention.

Furthermore, as shown in FIG. 5 and FIG. 6, the setting 6 of the third embodiment of the present invention comprises a first face brace 9 and a second face brace 10. The first face brace 9 and the second face brace 10 comfortably mounts the structural base 11 around the face of the user. The first face brace 9 is mounted onto the first offset leg 14, and the second face brace 10 is mounted onto the second offset leg 15. In order to cushion the first face brace 9 and the second face brace 10 while resting on the face of the user, the at least one pad 1 comprises a first pad 4 and a second pad 5. The first pad 4 and the second pad 5 are preferably shaped to receive a human face. The first face brace 9 is mounted adjacent to the structural base 11, and the second face brace 10 is mounted adjacent to the structural base 11, opposite to the first base. The first pad 4 is mounted across the first face brace 9. Similarly, the second pad 5 is mounted across the second face brace 10.

A fourth embodiment of the present invention, illustrated in FIG. 6, further challenges a user by allowing the attached weighted item to tilt similar to that of the first and second embodiments of the present invention. In the fourth embodiment of the present invention, shown in FIG. 6, a concave portion of the first face brace 9 and a concave portion of the second face brace 10 are positioned concentric with each other. This arrangement accommodates the structure of the head of the user and prevents the view of the user from being obstructed. The concave portion of the first face brace 9 and the concave portion of the second face brace 10 is positioned about a shared axis 23. The barbell mount 17 is hingedly connected to the structural base 11 about a hinge axis 24. The shared axis 23 and the hinge axis 24 are positioned perpendicular to each other so that resistance against the attached weighted item is applied to forward and backward movement of the head of the user. The arrangement between the first offset leg 14 and second offset leg 15 with that of the bridge 16, the first face brace 9 and the second face brace 10 is preserved as that of the third embodiment of the present invention, effectively mounting the fourth embodiment of the present invention onto the face of the user while supporting the attached weighted item.

In order for a weighted item to be attached to the first embodiment, the second embodiment, the third embodiment, and the fourth embodiment of the present invention, the barbell mount 17 comprises a stabilizing bar 18, a female-threaded hole 19, a male-threaded shaft 20, and a clamp 22, seen in FIG. 1, FIG. 2, FIG. 3, FIG. 4, FIG. 5, and FIG. 6. The stabilizing bar 18 connects the clamp 22 to the structural base 11. In the preferred embodiment of the present invention, the stabilizing bar 18 is fixed between a third pair of clevis tabs. The third pair of clevis tabs are mounted onto the structural base 11, opposite the setting 6. Similar to the first pair of clevis tabs 8 and the second pair of clevis tabs 13, the third pair of clevis tabs is positioned parallel and offset from each other across the structural base 11. The female-threaded hole 19 positions the male-threaded shaft along the stabilizing bar 18. The male-threaded shaft connects the clamp 22 to the stabilizing bar 18, and the wingnut 21 fastens the male-threaded shaft 20 to the stabilizing bar 18. The clamp 22 attaches a wide variety of weighted items, preferably weighted items with a rod or handlebar. In order to connect a weighted item to the structural base 11, the female-threaded hole 19 laterally traverses through the stabilizing bar 18, and the male-threaded shaft is engaged through the female-threaded hole 19. The engagement is secured with the wingnut 21 as the wingnut 21 is terminally engaged to the male-threaded shaft 20. The clamp 22 is terminally fixed to the male-threaded shaft, opposite to the wingnut 21, orienting the weighted item away from the structural base 11. More specifically, the stabilizing bar 18 is positioned in between the clamp 22 and the wingnut 21 and is mounted offset from the structural base 11.

Although the invention has been explained in relation to its preferred embodiment, it is to be understood that many other possible modifications and variations can be made without departing from the spirit and scope of the invention as hereinafter claimed.

What is claimed is:

1. A weighted target applicator comprises:
- at least one pad;
- a setting;
- a structural base;
- a barbell mount;
- the at least one pad being detachably attached onto the setting;
- the structural base being mounted onto the setting, opposite to the at least one pad;
- the barbell mount being mounted onto the structural base, opposite the setting;
- the structural base comprises a first offset leg, a second offset leg, and a bridge;
- the setting comprises a first face brace and a second face brace;
- the first offset leg being terminally mounted to the bridge;
- the second offset leg being terminally mounted to the bridge, opposite the first offset leg;
- the setting being mounted onto the first offset leg and the second offset leg;
- the barbell clamp being mounted onto the bridge in between the first offset leg and the second offset leg;
- the first face brace being mounted onto the first offset leg; and,
- the second face brace being mounted onto the second offset leg.

2. The weighted target applicator as claimed in claim 1 comprises:
- the setting comprises a first platform and a first pair of clevis tabs;
- the at least one pad being mounted across the first platform;
- the first pair of clevis tabs being mounted onto the first platform, opposite the at least one pad;
- the first pair of clevis tabs being positioned parallel and offset from each other across the first platform; and,
- the structural base being rotatably connected to the first pair of clevis tabs.

3. The weighted target applicator as claimed in claim 1 comprises:
- the structural base comprises a second platform and a second pair of clevis tabs;
- the barbell mount being mounted onto the second platform;
- the second pair of clevis tabs being mounted onto the second platform, opposite to the barbell mount;
- the second pair of clevis tabs being positioned parallel and offset from each other across the second platform; and,
- the setting being rotatably connected to the second pair of clevis tabs.

4. The weighted target applicator as claimed in claim 1 comprises:
- the at least one pad comprises a first planar portion and a second planar portion;
- the first planar portion being mounted across the setting; and,
- the second planar portion being peripherally and perpendicularly connected to the first planar portion.

5. The weighted target applicator as claimed in claim 1 comprises:
- a concave portion of the first face brace and a concave portion of the second face brace being positioned concentric with each other;
- the concave portion of the first face brace and the concave portion of the second face brace being positioned about a shared axis;

the barbell mount being hingedly connected to the structural base about a hinge axis; and, the shared axis and the hinge axis being positioned perpendicular to each other.

6. The weighted target applicator as claimed in claim 1 comprises:

the at least one pad comprises a first pad and a second pad;

the setting comprises a first face brace and a second face brace;

the first face brace being mounted adjacent to the structural base;

the second face brace being mounted adjacent to the structural base, opposite to the first face brace;

the first pad being mounted across the first face brace; and, the second pad being mounted across the second face brace.

7. The weighted target applicator as claimed in claim 6, wherein the first pad and the second pad are shaped to receive a human face.

8. The weighted target applicator as claimed in claim 1 comprises:

the barbell mount comprises a stabilizing bar, a female-threaded hole, a male-threaded shaft, a wingnut, and a clamp;

the female-threaded hole laterally traversing through the stabilizing bar;

the male-threaded shaft being engaged through the female-threaded hole;

the wingnut being terminally engaged to the male-threaded shaft;

the clamp being terminally fixed to the male-threaded shaft, opposite to the wingnut;

the stabilizing bar being positioned in between the clamp and the wingnut; and, the stabilizing bar being mounted offset from the structural base.

* * * * *